US010688818B2

(12) United States Patent
Ando

(10) Patent No.: US 10,688,818 B2
(45) Date of Patent: Jun. 23, 2020

(54) PRINTER

(71) Applicant: Seiko Instruments Inc., Chiba-shi, Chiba (JP)

(72) Inventor: Norihisa Ando, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 16/292,460

(22) Filed: Mar. 5, 2019

(65) Prior Publication Data

US 2019/0275816 A1 Sep. 12, 2019

(30) Foreign Application Priority Data

Mar. 8, 2018 (JP) ..... 2018-041617

(51) Int. Cl.

| | |
|---|---|
| ***B41J 3/36*** | (2006.01) |
| ***B41J 29/02*** | (2006.01) |
| ***B41J 29/393*** | (2006.01) |
| ***B41J 29/13*** | (2006.01) |
| *B41J 3/407* | (2006.01) |

(52) U.S. Cl.

CPC ..... *B41J 29/02* (2013.01); *B41J 3/36* (2013.01); *B41J 29/13* (2013.01); *B41J 29/393* (2013.01); *B41J 3/4075* (2013.01); *B41J 2029/3932* (2013.01); *G03G 2221/1681* (2013.01)

(58) Field of Classification Search

CPC ... B41J 3/36; B41J 29/13; B41J 20/393; B41J 29/02

See application file for complete search history.

(56) References Cited

U.S. PATENT DOCUMENTS

| | | | |
|---|---|---|---|
| 2012/0050448 | A1 | 3/2012 | Sakaino |
| 2016/0075156 | A1 | 3/2016 | Corvese et al. |
| 2017/0367467 | A1 | 12/2017 | Kato et al. |

FOREIGN PATENT DOCUMENTS

| | | | |
|---|---|---|---|
| EP | 1084851 | A2 | 3/2001 |
| EP | 1084851 | A3 | 2/2002 |
| JP | 2012-45808 | A | 3/2012 |

OTHER PUBLICATIONS

Extended European Search Report for Europe Application No. 19161394.2, dated Sep. 9, 2019, 7 pages.

*Primary Examiner* — Lamson D Nguyen

(74) *Attorney, Agent, or Firm* — Brinks Gilson & Lione

(57) ABSTRACT

A printer for printing information on a recording sheet, includes a housing configured to accommodate the recording sheet and a printing portion; an attachment member, which is removably mounted to the housing, and has a hook hole for a strap. A portion of the housing, to which the attachment member is mounted, and the attachment member form a rotation regulating portion configured to regulate rotation of the attachment member.

4 Claims, 11 Drawing Sheets

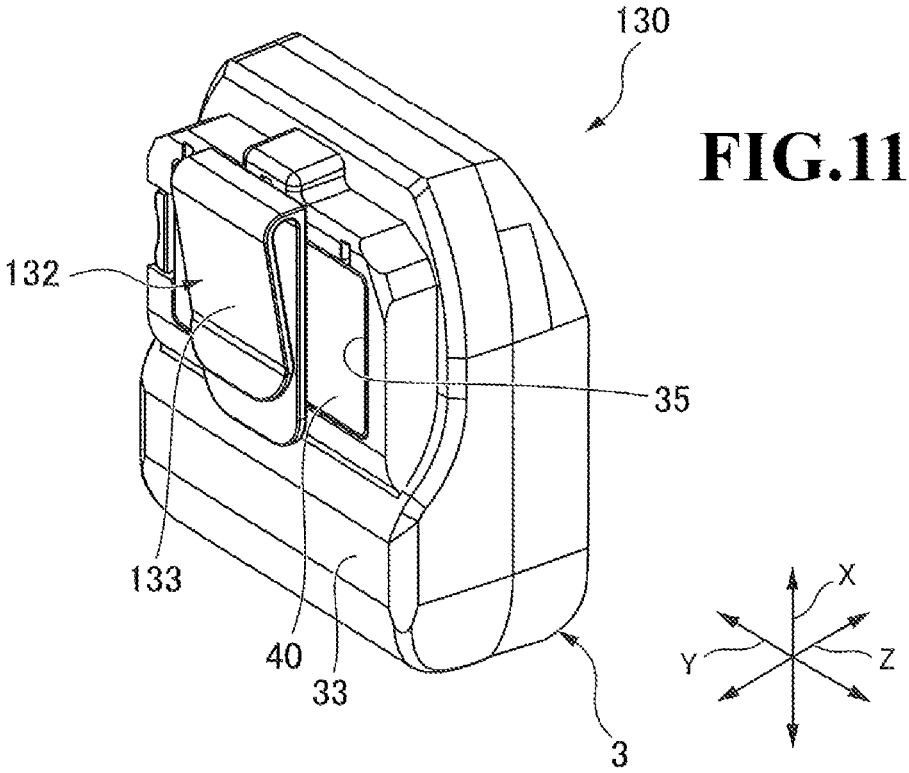
FIG.11A
FIG.11B
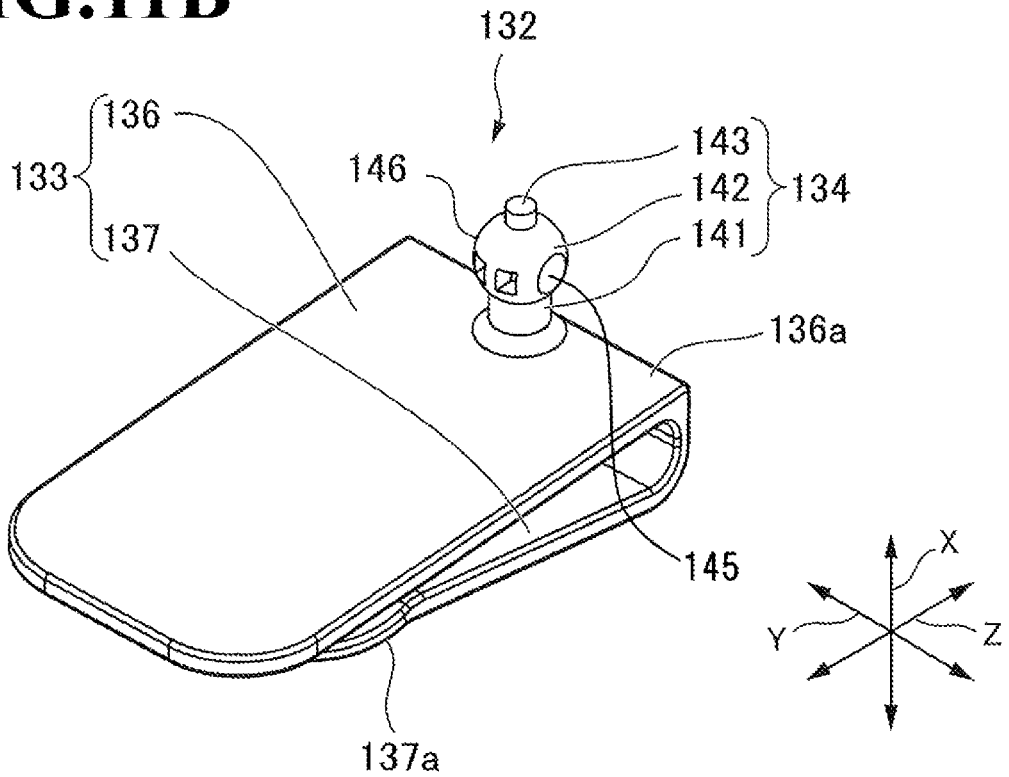

PRINTER

RELATED APPLICATIONS

This application claims priority under 35 U.S.C. § 119 to Japanese Patent Application No. 2018-041617 filed on Mar. 8, 2018, the entire content of which is hereby incorporated by reference.

BACKGROUND OF THE INVENTION

1. Field of the Invention

The present invention relates to a printer.

2. Description of the Related Art

Hitherto, there have been widely used portable devices such as a mobile printer, which can be readily carried by a person. In general, such portable device includes a battery that is to be removably mounted to a housing (hereinafter referred to as "casing") so as to enable the portable device to be used under a cordless state.

Further, in many cases, a portable device includes a hook portion for mounting a strap, which is formed in a part of the casing so as to enable a user to use the portable device while suspending the portable device from a shoulder or a neck through a strap.

However, the portable device of this type is not always used under a state of being suspended from a shoulder or a neck. In some cases, the portable device is used under a state of being put at a predetermined position without being carried. In those cases, the strap and the hook portion are useless, and occupy a needless installation space.

In view of this, in the printer of this type, it has been required that the strap can be removably mounted to the printer as needed.

SUMMARY OF THE INVENTION

According to one embodiment of the present invention, there is provided a printer, including a housing configured to accommodate a recording sheet and a printing portion; an attachment member, which is removably mounted to the housing, and has a hook hole for a strap, wherein a portion of the housing, to which the attachment member is mounted, and the attachment member form a rotation regulating portion configured to regulate rotation of the attachment member.

In the above-mentioned printer according to the one embodiment of the present invention, the printer further including a battery accommodation portion formed in the housing; and a battery, which is to be removably mounted to the battery accommodation portion, wherein the housing includes a connecting recessed portion having an opening portion formed in a side wall of the battery accommodation portion, wherein the attachment member includes a connecting projecting portion that is removably fitted to the connecting recessed portion through the opening portion, and wherein, under a state in which the connecting projecting portion is fitted to the connecting recessed portion, when the battery is mounted to the battery accommodation portion, the attachment member is mounted to the housing.

In the above-mentioned printer according to the one embodiment of the present invention, wherein the rotation regulating portion is formed by the connecting projecting portion and the connecting recessed portion.

In the above-mentioned printer according to the one embodiment of the present invention, wherein the rotation regulating portion includes an engagement portion configured to regulate oration of the attachment member.

In the above-mentioned printer according to the one embodiment of the present invention, wherein the attachment member includes a rib configured to regulate the rotation of the attachment member by being fitted to the housing.

BRIEF DESCRIPTION OF THE DRAWINGS

FIG. 11A is a perspective view for illustrating a printer according to a second embodiment of the present invention as seen from a back wall side thereof.

FIG. 11B is a perspective view for illustrating a belt clip in the second embodiment of the present invention.

DETAILED DESCRIPTION OF THE PREFERRED EMBODIMENTS

First Embodiment

Figure 1:
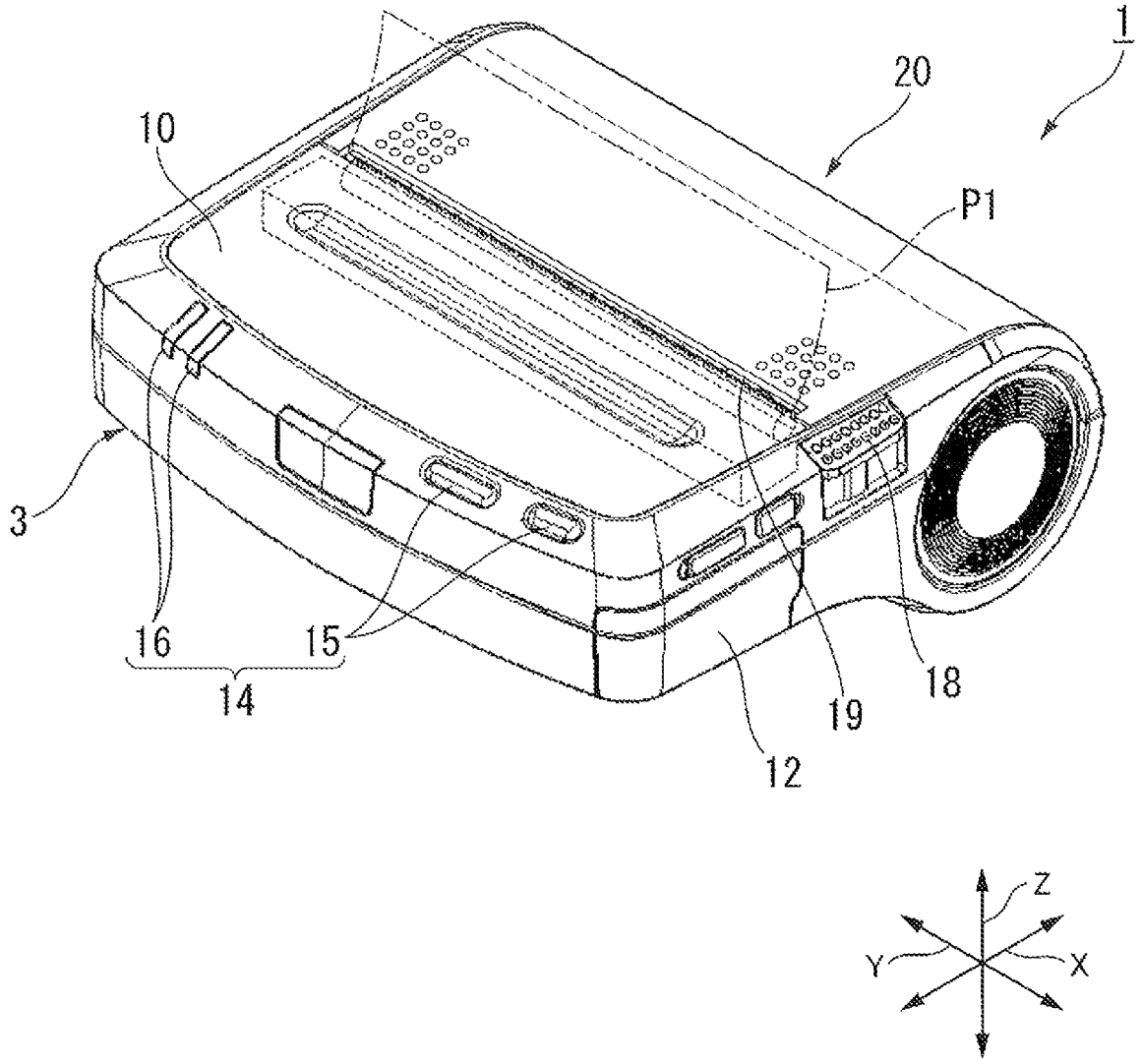
FIG. 1 is a perspective view for illustrating a printer according to a first embodiment of the present invention when a paper cover is positioned at a closed position.
Figure 2:
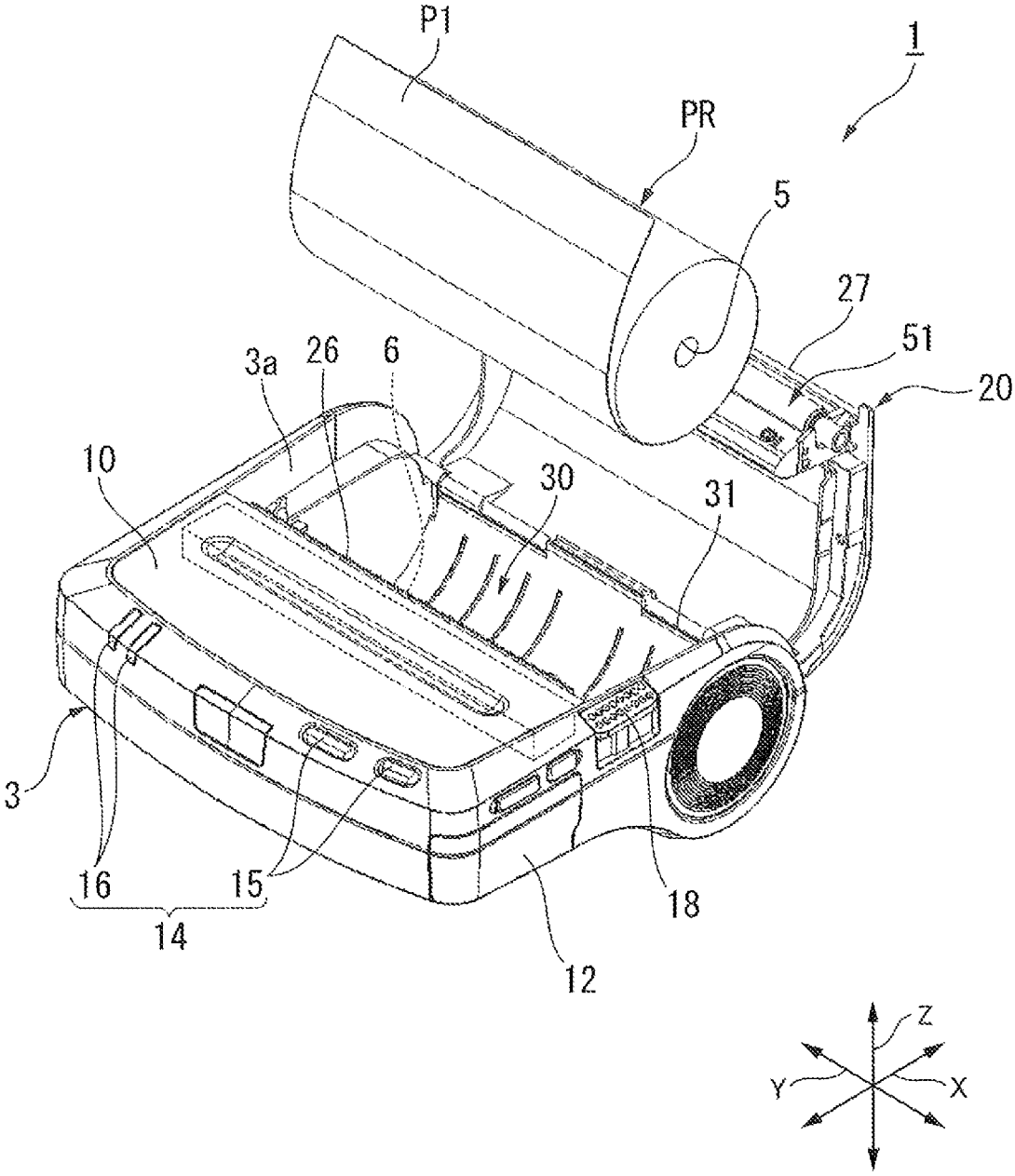
FIG. 2 is a perspective view for illustrating the printer according to the first embodiment of the present invention when the paper cover is positioned at an open position.

FIG. 1 is a perspective view for illustrating a printer 1 as seen from a front surface side thereof when a paper cover 20 is positioned at a closed position. FIG. 2 is a perspective view for illustrating the printer 1 as seen from the front surface side when the paper cover 20 is positioned at an open position. In FIG. 1 and FIG. 2, illustration is made of the printer 1 to be used under a state of being placed on an installation surface. In the following description, in the drawings, a direction indicated by the arrows X, a direction indicated by the arrows Y, and a direction indicated by the arrows Z are defined as a length direction, a width direction, and an up-and-down direction, respectively.

As illustrated in FIG. 1, the printer 1 is configured to be capable of performing printing on a recording sheet P1. In a first embodiment of the present invention, a thermal printer is given as an example of the printer 1, but the printer 1 is not limited to the thermal printer. The recording sheet P1 is a heat-sensitive sheet that develops color through application of heat, and is suitably used for printing, for example, a variety of labels, receipts, and tickets. As illustrated in FIG. 2, the recording sheet P1 is set in the printer 1 under a state of a roll sheet PR having a hollow hole 5, which is obtained by winding the recording sheet P1. A printing portion 6 is configured to perform printing on a part drawn out from the roll sheet PR.

The printer 1 includes a casing (housing) 3 having an opening portion 3*a*, the paper cover 20 configured to open and close the opening portion 3*a* of the casing 3, a battery 40 for charging, and an attachment member 50 (see FIG. 3) for carrying. Further, a printer module 30 is mounted inside the printer 1.

The casing 3 is made of plastic such as polycarbonate or a metal material. The casing 3 is formed into such a box shape that a region on one side in the X direction is formed into a substantially rectangular parallelepiped shape having a front wall 10, and that a region on another side in the X direction is opened to one side in the Z direction (to the front wall 10 side). For example, a rib (not shown) is formed on an inner surface of the casing 3, thereby reinforcing mechanical strength of the casing 3. An operation unit 14 is arranged on the front wall 10 of the casing 3, and is configured to perform various operations of the printer 1.

Various function switches 15 such as a power switch and a FEED switch are arranged in the operation unit 14. Moreover, various indicators 16 are arranged in the operation unit 14 to be adjacent to the various function switches 15. Examples of the indicators 16 include a POWER indicator configured to indicate information of an ON/OFF state of the power switch, and an ERROR indicator configured to indicate, for example, an error of the printer 1. Further, an open button 18 for the paper cover 20 is provided between the front wall 10 and a side wall 12 of the casing 3. Moreover, a first cutting blade 26 configured to cut the recording sheet P1 is formed at an edge of the front wall 10 of the casing 3 on the another side in the X direction.

The paper cover 20 is made of plastic such as polycarbonate. A proximal end portion of the paper cover 20 on the another side in the X direction is supported by a hinge shaft so that the paper cover 20 is rotatable with respect to a main body frame 31 of the printer module 30. Further, a distal end portion of the paper cover 20 is configured to be capable of being locked to the main body frame 31 by a platen roller 51 mounted to the distal end portion of the paper cover 20. Through pressing of the open button 18 of the casing 3, locking between the paper cover 20 and the casing 3, in which the main body frame 31 is mounted, is cancelled so that the paper cover 20 can be opened from the closed position (see FIG. 1) to the open position (see FIG. 2).

Further, as illustrated in FIG. 1, when the paper cover 20 is positioned at the closed position, a gap is defined along the width direction of the recording sheet P1 between a distal edge of the paper cover 20 and the edge of the front wall 10 of the casing 3 on the another side in the X direction. The gap forms a delivery slot 19 through which the recording sheet P1 subjected to printing is delivered. Moreover, a second cutting blade 27 (see FIG. 2) configured to cut the recording sheet P1 is formed at the distal end portion of the paper cover 20. Printing is performed on the recording sheet P1 in the printing portion 6, and the recording sheet P1 subjected to printing is delivered through the delivery slot 19. The recording sheet P1 delivered through the delivery slot 19 is cut by being pulled down in a contact state with the first cutting blade 26 or the second cutting blade 27.

Figure 3:
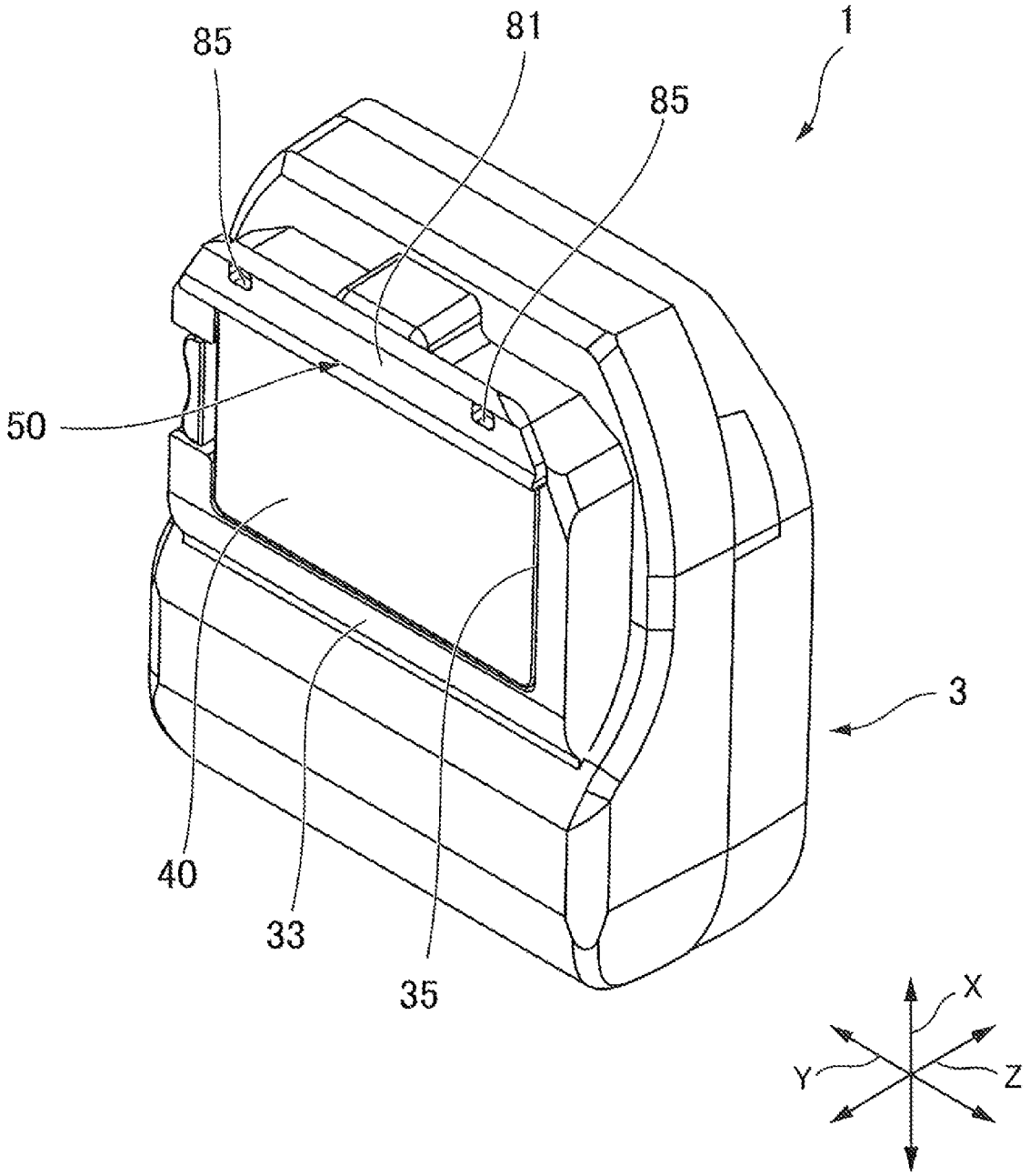
FIG. 3 is a perspective view for illustrating the printer according to the first embodiment of the present invention as seen from a back wall side thereof.

FIG. 3 is a perspective view for illustrating the printer 1 as seen from a back wall 33 side. As illustrated in FIG. 3, the battery 40 and the attachment member 50 are mounted to the back wall 33 of the casing 3. A battery accommodation portion 35 is formed on the back wall 33 of the casing 3. The battery 40 is removably mounted to the battery accommodation portion 35. The battery 40 is formed into a rectangular shape. When the battery 40 is accommodated in the battery accommodation portion 35, the battery 40 can be used as a power source for the printer 1. Thus, the printer 1 can be used as a portable terminal in a cordless state.

Figure 4:
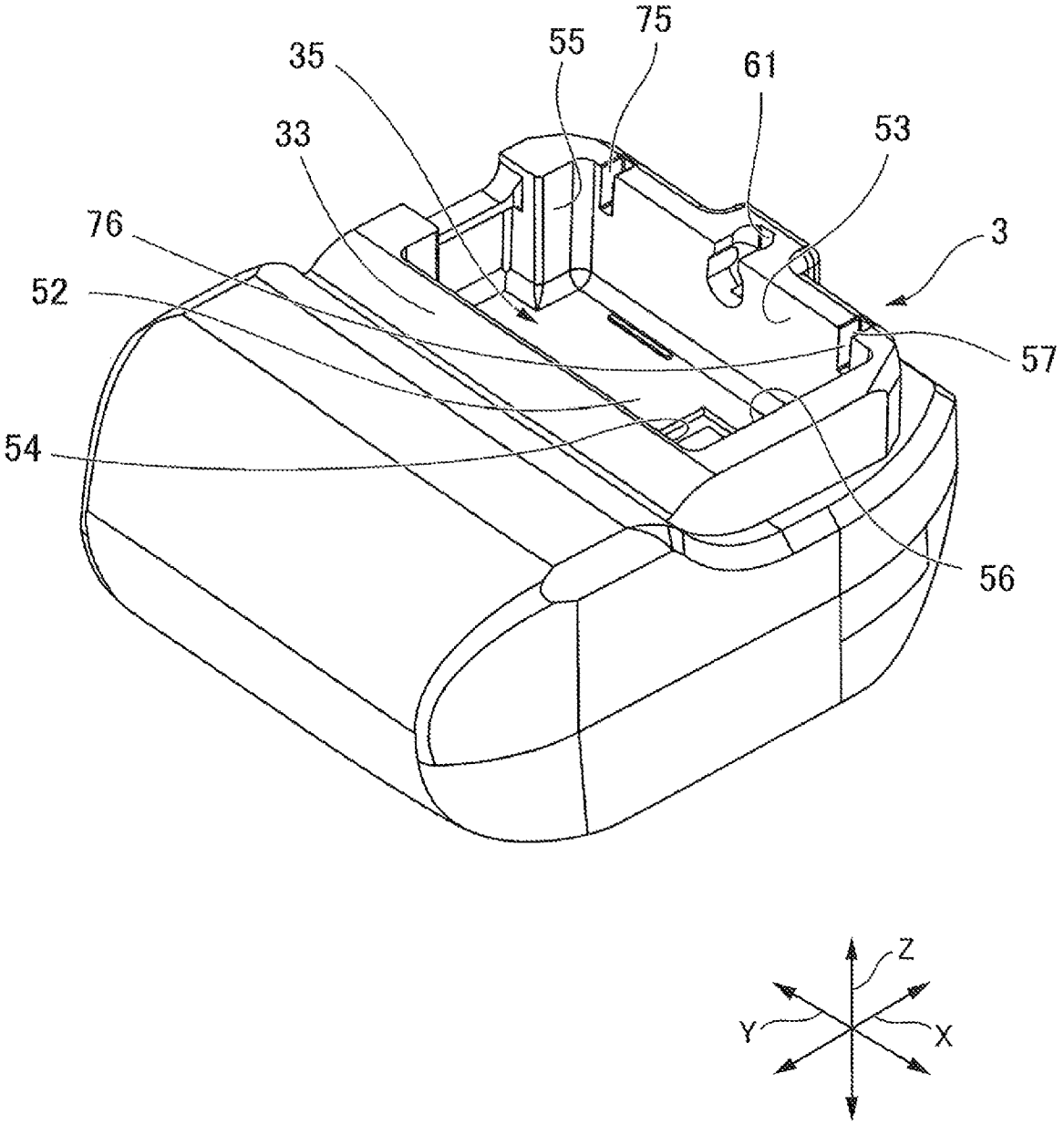
FIG. 4 is a perspective view for illustrating the printer according to the first embodiment of the present invention from which an attachment member and a battery are removed.

FIG. 4 is a perspective view for illustrating the printer 1 from which the attachment member 50 and the battery 40 are removed. As illustrated in FIG. 4, the battery accommodation portion 35 includes an accommodation bottom portion 52 and an accommodation opening portion 57. The accommodation opening portion 57 is formed into a rectangular recessed shape by first to fourth side walls 53 to 56 to be opened in the back wall 33. The accommodation bottom portion 52 is formed into a rectangular shape. The first to fourth side walls 53 to 56 extend upright from four sides of the accommodation bottom portion 52 toward the back wall 33, and thus form a rectangular frame shape. The first side wall (side wall) 53 and the second side wall 54 are formed with an interval in the X direction. The first side wall 53 is formed at an end portion of the back wall 33 of the casing 3 on the one side in the X direction. The second side wall 54 is formed at a center region of the back wall 33 of the casing 3 in the X direction. The third side wall 55 and the fourth side wall 56 are formed with an interval in the Y direction. The battery 40 is freely removably accommodated in the battery accommodation portion 35 through the accommodation opening portion 57 formed in the back wall 33 of the casing 3.

Figure 5:
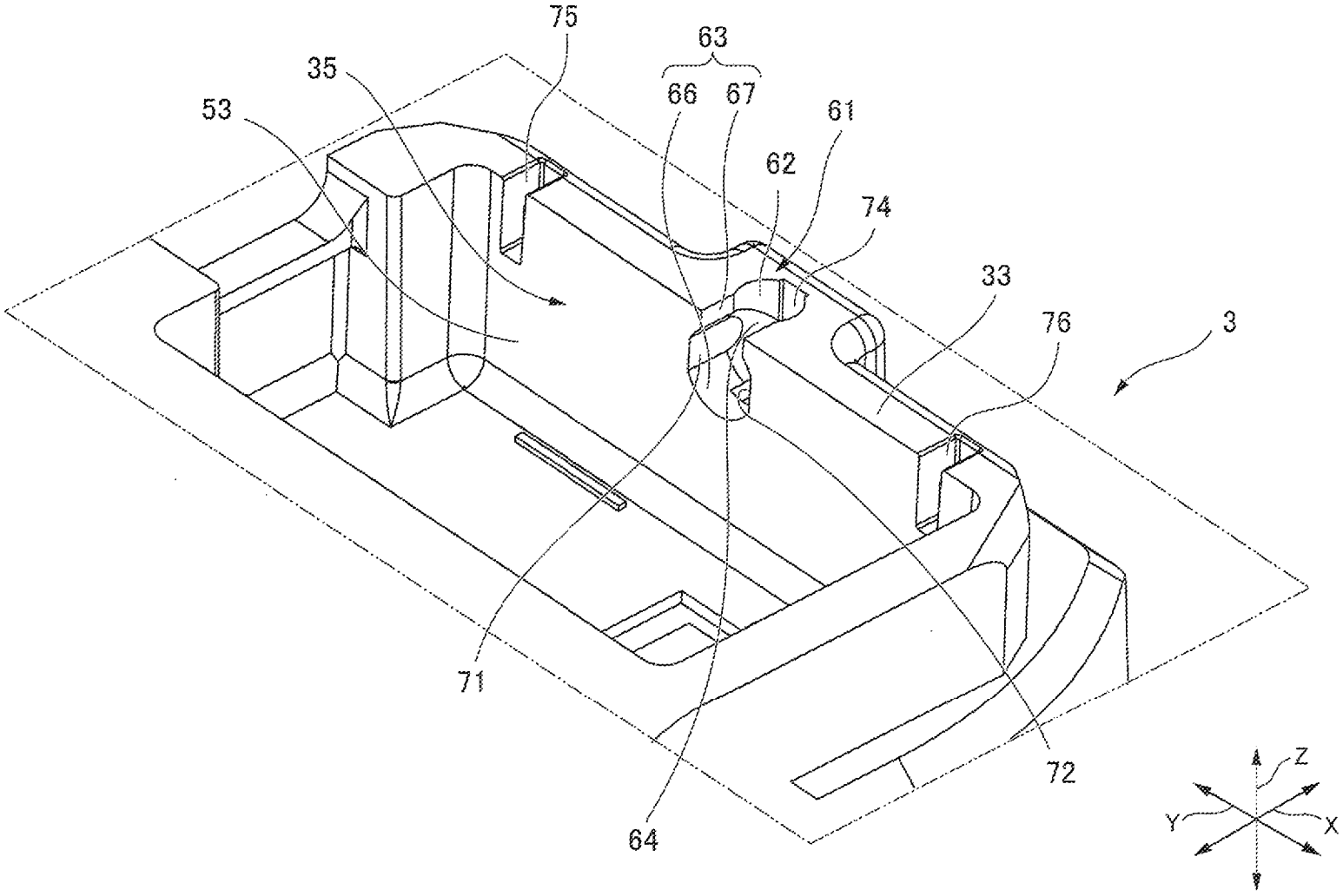
FIG. 5 is a perspective view for illustrating a connecting recessed portion and insertion recessed portions of a casing in the first embodiment of the present invention.

FIG. 5 is a perspective view for illustrating a connecting recessed portion 61 and first and second insertion recessed portions 75 and 76 of the casing 3. As illustrated in FIG. 5, the connecting recessed portion 61 and the pair of insertion recessed portions 75 and 76 are formed in the back wall 33 of the casing 3. The connecting recessed portion 61 is formed so as to communicate with the battery accommodation portion 35. The connecting recessed portion 61 includes a first opening portion 62, a second opening portion (opening portion) 63, and a spherical receiving portion 64. The connecting recessed portion 61 is formed into a recessed portion by the first opening portion 62, the second opening portion 63, and the spherical receiving portion 64. The first opening portion 62 is formed at a vicinity of the first side wall 53 and at a center in the Y direction in the back wall 33 of the casing 3, and has an arc shape with a diameter D1. The first opening portion 62 is formed so as to communicate with the spherical receiving portion 64 in the Z direction. The second opening portion 63 is formed at a center in the Y direction in the first side wall 53 of the battery accommodation portion 35.

The second opening portion 63 includes a circular opening portion 66 and a connecting opening portion 67. The circular opening portion 66 is formed into a circular shape with a diameter D2, and is formed so as to allow the battery accommodation portion 35 to communicate with the spherical receiving portion 64 in the X direction. The connecting opening portion 67 is formed so as to allow the battery accommodation portion 35 to communicate with the first opening portion 62 in the X direction. An opening width W1 of the connecting opening portion 67 in the Y direction is set to be smaller than the diameter D1 of the first opening portion 62 and the diameter D2 of the circular opening portion 66.

The spherical receiving portion 64 is formed so as to communicate with the circular opening portion 66 and the first opening portion 62. The spherical receiving portion 64 is formed into a spherical shape having a dimension of a diameter D3. The diameter D3 of the spherical receiving portion 64 is set to be equal to the diameter D2 of the circular opening portion 66 and larger than the diameter D1 of the first opening portion 62. On both side regions of the spherical receiving portion 64 and the circular opening portion 66, which are opposed to each other in the Y direction, a pair of chamfered portions (engagement portions) 71 and 72 are formed to be flat. In the following description, the pair of chamfered portions 71 and 72 is referred to as the first chamfered portion 71 and the second chamfered portion 72. A chamfer width W2 between the first chamfered portion 71 and the second chamfered portion 72 is set to be smaller than the diameter D3 of the spherical receiving portion 64 and the diameter D2 of the circular opening portion 66.

A guide groove portion 74 is formed at a center in the Y direction of a region containing the spherical receiving portion 64, the first opening portion 62, and the circular opening portion 66. Specifically, the guide groove portion 74 extends from the first opening portion 62 via the spherical receiving portion 64 to a midway of the circular opening portion 66. A connecting projecting portion (joint portion) 77 (see FIG. 7) of the attachment member 50 is coupled to the connecting recessed portion 61 formed as described above. When the connecting projecting portion 77 is coupled to the connecting recessed portion 61, the attachment member 50 is mounted to the back wall 33 of the casing 3 (see FIG. 3). That is, the back wall 33 of the casing 3 is a region to which the attachment member 50 is to be mounted.

The pair of insertion recessed portions 75 and 76 is formed on both sides of the connecting recessed portion 61 in the Y direction. In the following description, the pair of insertion recessed portions 75 and 76 is referred to as the first insertion recessed portion 75 and the second insertion recessed portion 76. The first insertion recessed portion 75 is formed in the back wall 33 of the casing 3 and the first side wall 53 of the battery accommodation portion 35. The second insertion recessed portion 76 is formed in the back wall 33 of the casing 3 and the first side wall 53 of the battery accommodation portion 35.

Figure 6:
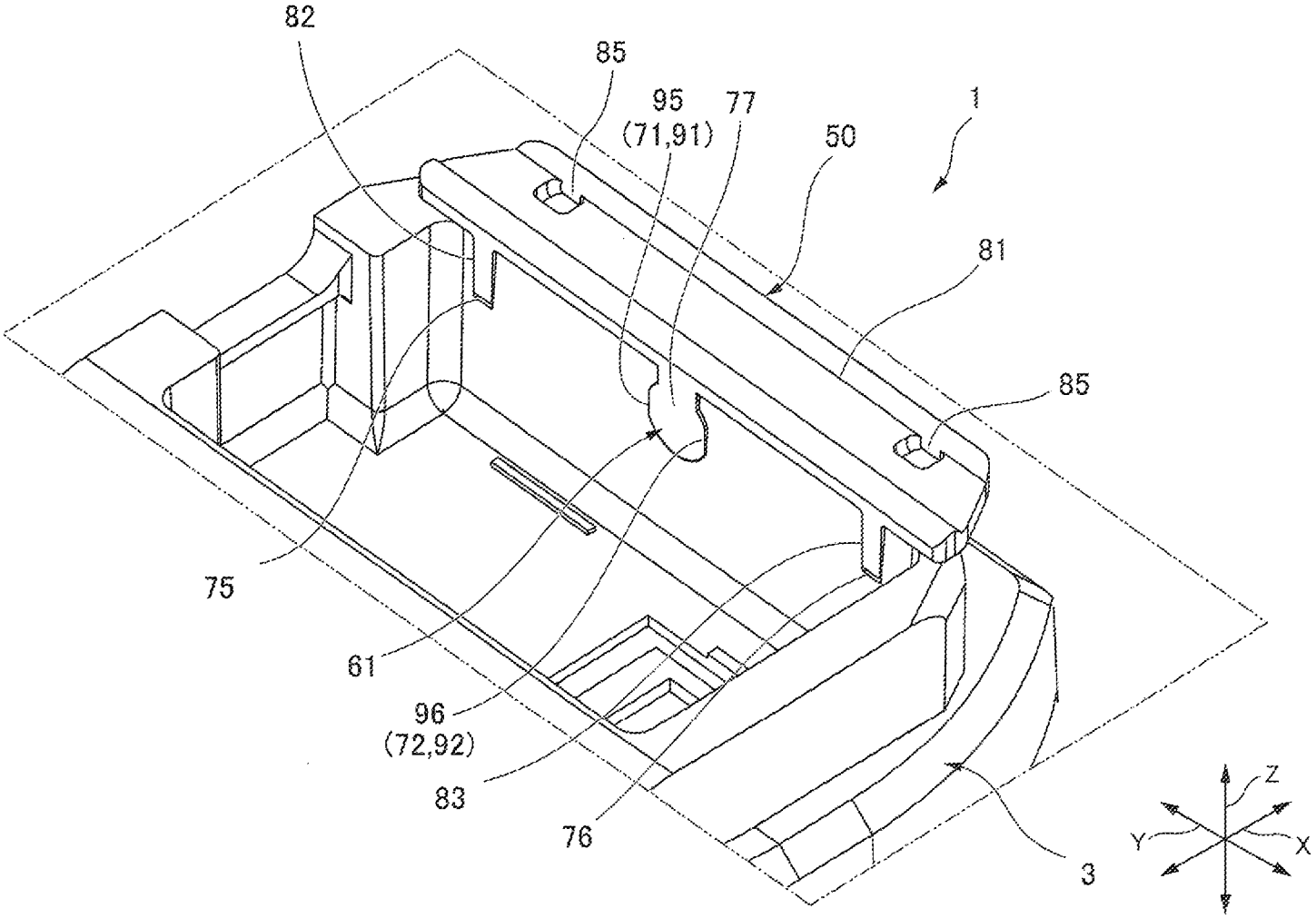
FIG. 6 is a perspective view for illustrating a state in which the attachment member is fitted to the connecting recessed portion and the insertion recessed portions of the casing in the first embodiment of the present invention.
Figure 7:
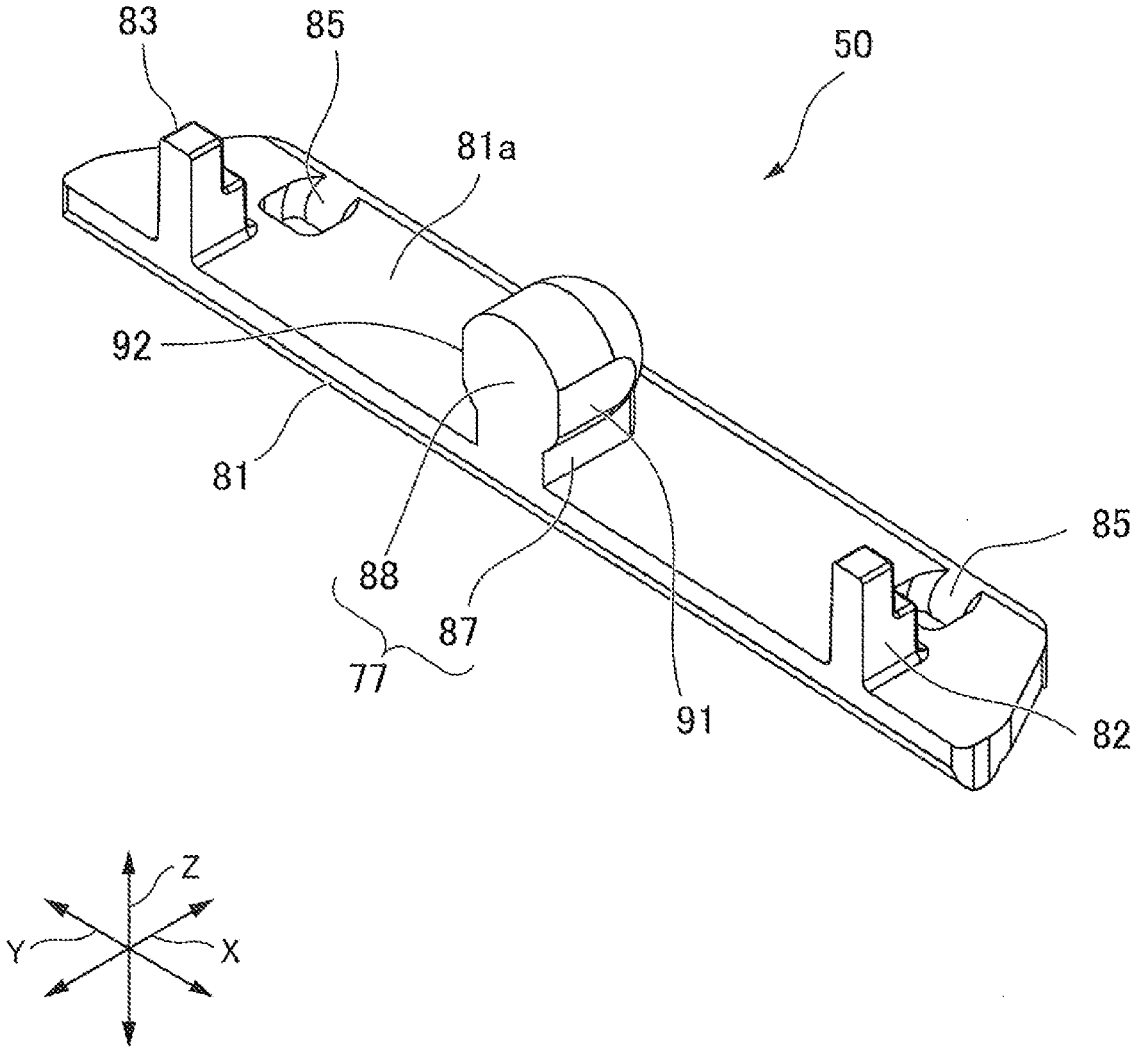
FIG. 7 is a perspective view for illustrating the attachment member in the first embodiment of the present invention.

FIG. 6 is a perspective view for illustrating a state in which the attachment member 50 is fitted to the connecting recessed portion 61 and the first and second insertion recessed portions 75 and 76 of the casing 3. FIG. 7 is a perspective view for illustrating the attachment member 50. As illustrated in FIG. 6 and FIG. 7, the attachment member 50 is freely removably mounted to the connecting recessed portion 61, the first insertion recessed portion 75, and the second insertion recessed portion 76. The attachment member 50 is integrally formed of a resin material, and includes a support bracket 81, the connecting projecting portion 77, and a pair of ribs 82 and 83.

The support bracket 81 is formed into a flat plate-like shape, and has a pair of hook holes 85 in both end portions thereof in the Y direction. The pair of hook holes 85 is formed to enable a strap to be coupled to the attachment member 50 through insertion of the strap. The connecting projecting portion 77 and the pair of ribs 82 and 83 are formed on a back surface 81*a* of the support bracket 81.

The connecting projecting portion 77 is formed at a center of the back surface 81*a* of the support bracket 81 in the Y direction. The connecting projecting portion 77 includes a joint neck portion 87 and a joint columnar body 88. The joint neck portion 87 is protruded from the center of the support bracket 81 in the Y direction along the Z direction. The joint neck portion 87 is fitted to the first opening portion 62 (see FIG. 5) through the connecting opening portion 67. The joint columnar body 88 is formed so as to extend toward the X direction in a columnar shape. The joint columnar body 88 includes a pair of connecting chamfered portions (engagement portions) 91 and 92 at both ends thereof in the Y direction. In the following description, the pair of connecting chamfered portions 91 and 92 is referred to as the first connecting chamfered portion 91 and the second connecting chamfered portion 92. The first connecting chamfered portion 91 and the second connecting chamfered portion 92 are each formed into a flat surface.

The joint columnar body 88 is freely removably fitted to the connecting recessed portion 61 through the circular opening portion 66 (see FIG. 5). The joint columnar body 88 is fitted to the connecting recessed portion 61 through the circular opening portion 66, and the joint neck portion 87 is fitted to the first opening portion 62 through the connecting opening portion 67. In this manner, the connecting projecting portion 77 is coupled to the connecting recessed portion 61.

Under a state in which the connecting projecting portion 77 is coupled to the connecting recessed portion 61, the first connecting chamfered portion 91 and the first chamfered portion 71 are arranged so as to be held in contact with each other in an opposed state. In this state, the first connecting chamfered portion 91 and the first chamfered portion 71 (see FIG. 5) form a first rotation regulating portion 95. In other words, the first rotation regulating portion 95 includes the first connecting chamfered portion 91 and the first chamfered portion 71 (see FIG. 5). Further, the second connecting chamfered portion 92 and the second chamfered portion 72 are arranged so as to be held in contact with each other in an opposed state. In this state, the second connecting chamfered portion 92 and the second chamfered portion 72 form a second rotation regulating portion 96. In other words, the second rotation regulating portion 96 includes the second connecting chamfered portion 92 and the second chamfered portion 72. The first chamfered portion 71 and the second chamfered portion 72 are each a region to which the connecting projecting portion 77 (that is, the attachment member 50) is to be mounted.

That is, the first rotation regulating portion 95 and the second rotation regulating portion 96 are formed by the connecting projecting portion 77 and the connecting recessed portion 61. Accordingly, it is not required that the first rotation regulating portion 95 and the second rotation regulating portion 96 be provided individually. With this structure, the first rotation regulating portion 95 and the second rotation regulating portion 96 can be formed without increasing the number of components, and simplification of the configuration can be achieved. Thus, the number of components of the printer 1 is reduced so that increase in cost can be prevented and space saving of the printer 1 can be achieved.

As described above, under a state in which the connecting projecting portion 77 is fitted to the connecting recessed portion 61, the first rotation regulating portion 95 and the second rotation regulating portion 96 are formed. The joint columnar body 88 of the connecting projecting portion 77 is formed into a columnar shape. With this structure, the first rotation regulating portion 95, the second rotation regulating portion 96, and the joint columnar body 88 regulate the attachment member 50 from rotating with respect to the casing 3 in an X-Y plane direction and a Y-Z plane direction.

The pair of ribs 82 and 83 is integrally formed at the both end portions of the back surface 81*a* of the support bracket 81. In the following description, the pair of ribs 82 and 83 is referred to as the first rib 82 and the second rib 83. The first rib 82 is protruded from one end portion of the back surface 81*a* of the support bracket 81. The first rib 82 is fitted to the first insertion recessed portion 75 from the battery accommodation portion 35 side. The second rib 83 is protruded from another end portion of the back surface 81*a* of the support bracket 81. The second rib 83 is fitted to the second insertion recessed portion 76 from the battery accommodation portion 35 side. The first rib 82 is fitted to the first insertion recessed portion 75, and the second rib 83 is fitted to the second insertion recessed portion 76, with the result that the first rib 82 and the second rib 83 satisfactorily regulate the rotation of the attachment member 50.

Figure 8A:
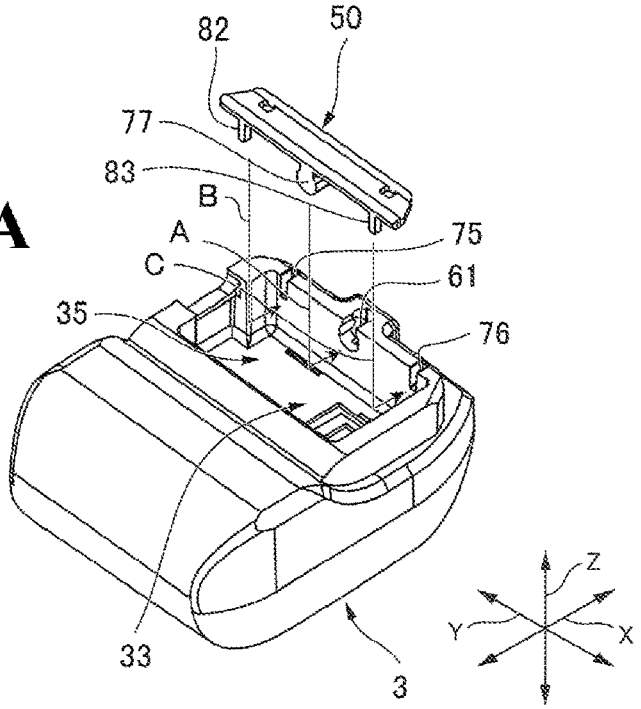
FIG. 8A is a perspective view for illustrating an example in which the attachment member is fitted to the connecting recessed portion and the insertion recessed portions of the casing in the first embodiment of the present invention.
Figure 8B:
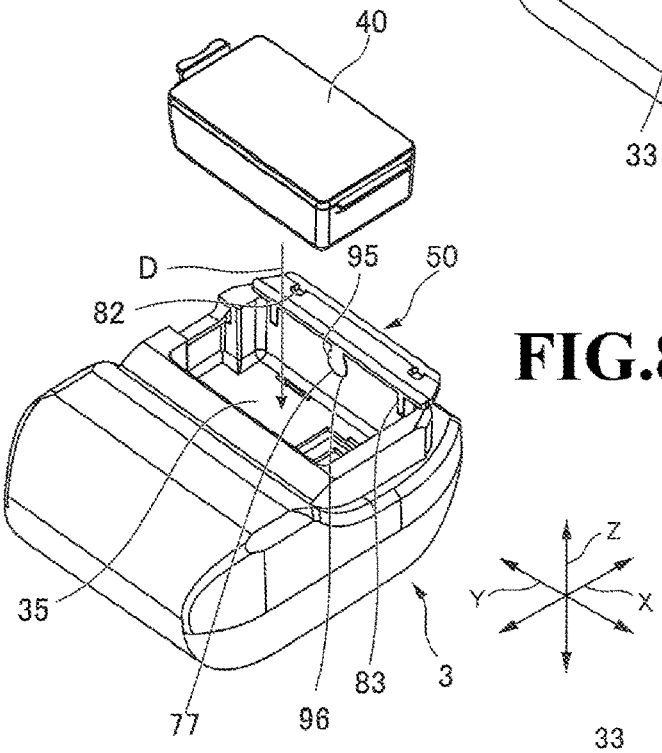
FIG. 8B is a perspective view for illustrating an example in which the battery is accommodated in a battery accommodation portion of the casing.
Figure 8C:
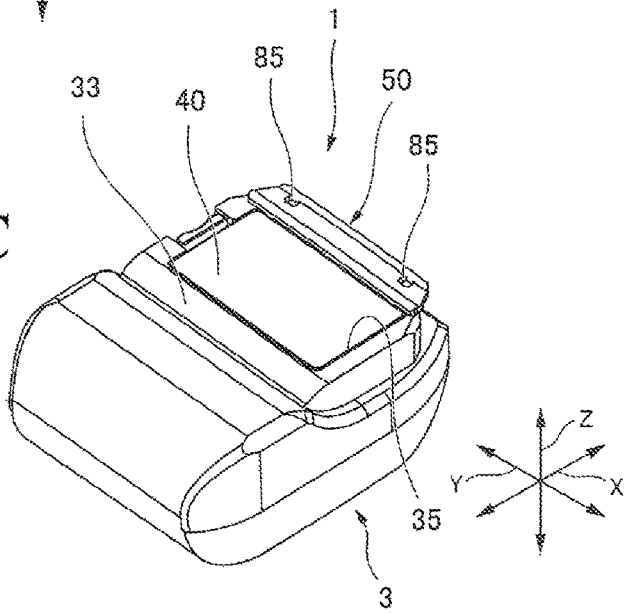
FIG. 8C is a perspective view for illustrating a state in which the battery is accommodated in the battery accommodation portion of the casing.

Next, with reference to FIG. 8A to FIG. 8C, description is made of an example in which the attachment member 50 is mounted to the back wall 33 of the casing 3. FIG. 8A is a perspective view for illustrating an example in which the attachment member 50 is fitted to the connecting recessed portion 61 and the first and second insertion recessed portions 75 and 76 of the casing 3. FIG. 8B is a perspective view for illustrating an example in which the battery 40 is accommodated in the battery accommodation portion 35 of the casing 3. FIG. 8C is a perspective view for illustrating a state in which the battery 40 is accommodated in the battery accommodation portion 35 of the casing 3.

As illustrated in FIG. 8A, under a state in which the battery 40 (see FIG. 3) is removed from the battery accommodation portion 35, the connecting projecting portion 77 of the attachment member 50 is fitted to the connecting recessed portion 61 from the battery accommodation portion 35 side in a direction indicated by the arrow A. The first rib 82 of the attachment member 50 is fitted to the first insertion recessed portion 75 from the battery accommodation portion 35 side in a direction indicated by the arrow B. The second rib 83 of the attachment member 50 is fitted to the second insertion recessed portion 76 from the battery accommodation portion 35 side in a direction indicated by the arrow C.

As illustrated in FIG. 8A and FIG. 8B, the connecting projecting portion 77, the first rib 82, and the second rib 83 of the attachment member 50 are fitted to the connecting recessed portion 61, the first insertion recessed portion 75, and the second insertion recessed portion 76, respectively (see FIG. 8A). In this state, the battery 40 is accommodated in the battery accommodation portion 35 in a direction indicated by the arrow D. Here, the joint columnar body 88 (see FIG. 7) of the connecting projecting portion 77 is formed into a columnar shape. Further, the connecting projecting portion 77 is fitted to the connecting recessed portion 61 so that the first rotation regulating portion 95 and the second rotation regulating portion 96 are formed. Moreover, the first rib 82 is fitted to the first insertion recessed portion 75, and the second rib 83 is fitted to the second insertion recessed portion 76. As a result, the first rotation regulating portion 95, the second rotation regulating portion 96, the first rib 82, and the second rib 83 regulate the attachment member 50 from rotating.

As illustrated in FIG. 8B and FIG. 8C, the battery accommodation portion 35 side of each of the connecting recessed portion 61, the first insertion recessed portion 75, and the second insertion recessed portion 76 (see FIG. 8A) is closed by the accommodated battery 40. Accordingly, the connecting projecting portion 77, the first rib 82, and the second rib 83 are held under a state of being fitted to the connecting recessed portion 61, the first insertion recessed portion 75, and the second insertion recessed portion 76, respectively. With this structure, the attachment member 50 can be prevented from being removed from the back wall 33 of the casing 3, and the attachment member 50 is mounted to the back wall 33 of the casing 3.

Meanwhile, when the attachment member is removed from the back wall 33 of the casing 3, the battery 40 is removed from the battery accommodation portion 35 so that the connecting projecting portion 77 can be removed from the connecting recessed portion 61 (see FIG. 8A). Further, the first rib 82 can be removed from the first insertion recessed portion 75 (see FIG. 8A). The second rib 83 can be removed from the second insertion recessed portion 76 (see FIG. 8A). Thus, the attachment member 50 can be easily mounted to and removed from the back wall 33 of the casing 3.

In the printer 1 according to the first embodiment, the attachment member 50 is removably mounted to the casing 3, and the pair of hook holes 85 is formed in the attachment member 50. A strap is mounted to the pair of hook holes 85. Accordingly, the strap can be removably mounted to the attachment member 50. With this structure, when the printer 1 is used under a carried state, the attachment member 50 is mounted to the casing 3 so that the strap can be mounted to the printer 1 through intermediation of the attachment member 50. Through use of the strap, the printer 1 can be used under a carried state of being suspended from a shoulder or a neck.

Meanwhile, when the printer 1 is used under a state of being put at a predetermined position without being carried, the attachment member 50 can be removed from the back wall 33 of the casing 3. In a case in which the attachment member 50 is removed from the back wall 33 of the casing 3, the battery 40 is removed from the battery accommodation portion 35. In this state, the connecting projecting portion 77, the first rib 82, and the second rib 83 of the attachment member 50 are removed from the connecting recessed portion 61, the first insertion recessed portion 75, and the second insertion recessed portion 76, respectively (see FIG. 8A). In this manner, the attachment member 50 can be removed from the back wall 33 of the casing 3.

As described above, when the printer 1 is used under a state of being put at the predetermined position without being carried, the attachment member 50 can be removed from the casing 3. Accordingly, the attachment member 50 and the strap can be removed from the printer 1. With this structure, when the printer 1 is used under a state of being put at the predetermined position, it is not required to consider an installation space for installing the attachment member 50 and the strap, and thus an installation position for the printer 1 can be easily secured. Further, when the printer 1 is used under a state of being put at the predetermined position without being carried, the attachment member 50 and the strap can be omitted. Thus, cost of the printer 1 can be reduced.

Further, the rotation of the attachment member 50 is regulated by the first rotation regulating portion 95, the second rotation regulating portion 96, the first rib 82, and the second rib 83. Accordingly, when the printer 1 is in the carried state of being suspended from a shoulder or a neck through use of the strap, the printer 1 can be kept in a stable state when the recording sheet P1 is cut through use of the first cutting blade 26 or the second cutting blade 27 (that is, a manual cutter) illustrated in FIG. 2. Thus, the recording sheet P1 can be unforcibly and satisfactorily cut by the first cutting blade 26 or the second cutting blade 27, and hence operability of the printer 1 can be enhanced.

Figure 9:
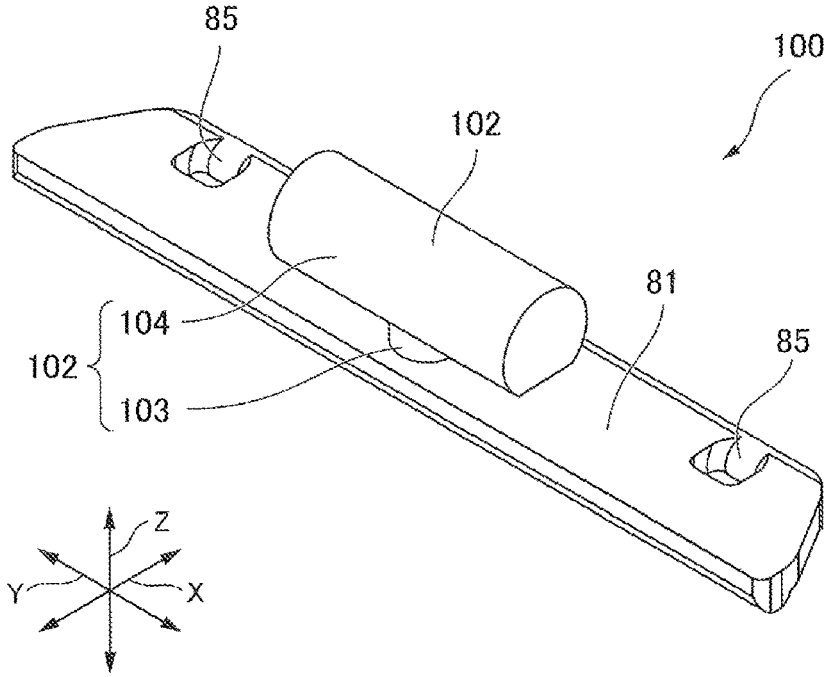
FIG. 9 is a perspective view for illustrating an attachment member in a first modification example of the first embodiment of the present invention.
Figure 10:
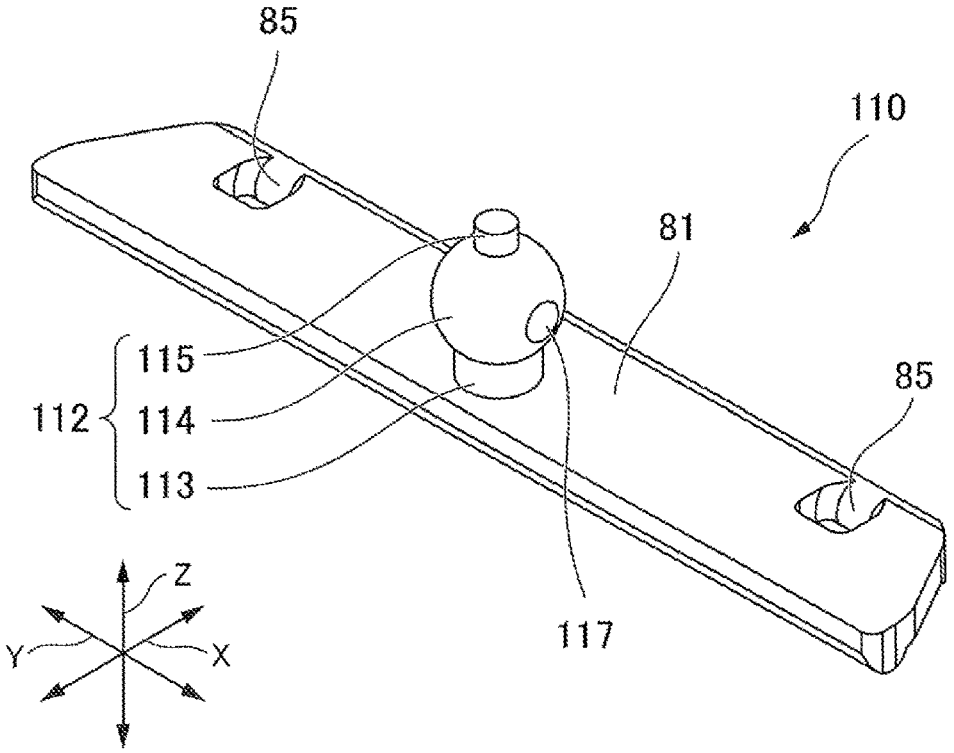
FIG. 10 is a perspective view for illustrating an attachment member in a second modification example of the first embodiment of the present invention.

Next, with reference to FIG. 9 and FIG. 10, description is made of an attachment member in each of a first modification example and a second modification example of the first embodiment. In the attachment member in each of the first modification example and the second modification example, components that are the same as or similar to those of the attachment member 50 in the first embodiment are denoted by the same reference symbols, and detailed description thereof is omitted.

First Modification Example

FIG. 9 is a perspective view for illustrating an attachment member 100 in the first modification example. As illustrated in FIG. 9, in the attachment member 100, a connecting projecting portion (joint portion) 102 is used under place of the connecting projecting portion 77 in the first embodiment, and the remaining configuration is the same as that of the attachment member 50 in the first embodiment. The connecting projecting portion 102 includes a joint neck portion 103 and a joint columnar body 104. The joint neck portion 103 is formed similarly to, for example, the joint neck portion 87 in the first embodiment. The joint columnar body 104 is formed so as to extend toward the Y direction in a columnar shape. Accordingly, under a state in which the joint columnar body 104 (that is, the connecting projecting portion 102) is mounted to the back wall 33 of the casing 3, the joint columnar body 104 regulates the attachment member 100 from rotating with respect to the casing 3 in the X-Y plane direction.

According to the attachment member 100 in the first modification example, similarly to the attachment member 50 in the first embodiment, when the battery 40 is removed from the battery accommodation portion 35, the attachment member 100 can be easily mounted to and removed from the back wall 33 of the casing 3. Further, the rotation of the attachment member 100 is regulated by the joint columnar body 104. With this structure, when the printer 1 is in the carried state of being suspended from a shoulder or a neck through use of the strap, the printer 1 can be kept in a stable state when the recording sheet P1 is cut through use of the first cutting blade 26 or the second cutting blade 27 (see FIG. 2). Further, according to the attachment member 100 in the first modification example, similarly to the attachment member 50 in the first embodiment, the first rib 82 and the second rib 83 may be formed at both end portions of the support bracket 81, respectively.

Second Modification Example

FIG. 10 is a perspective view for illustrating an attachment member 110 in the second modification example. As illustrated in FIG. 10, in the attachment member 110, a connecting projecting portion (joint portion) 112 is used under place of the connecting projecting portion 77 in the first embodiment, and the remaining configuration is the same as that of the attachment member 50 in the first embodiment. The connecting projecting portion 112 includes a joint neck portion 113, a joint spherical body 114, and a joint shank portion 115. The joint neck portion 113, the joint spherical body 114, and the joint shank portion 115 are arranged to be coaxial with each other in the Z direction. The joint neck portion 113 is formed similarly to, for example, the joint neck portion 87 in the first embodiment. The joint spherical body 114 is formed into a spherical shape, and includes a pair of spherical chamfered portions 117.

The pair of the spherical chamfered portions 117 is formed on portions of the joint spherical body 114, which are opposed to each other with an interval in the Y direction. Accordingly, under a state in which the joint spherical body 114 (that is, the connecting projecting portion 112) is mounted to the back wall 33 of the casing 3, the joint spherical body 114 regulates the attachment member 110 from rotating with respect to the casing 3 in the X-Y plane direction.

According to the attachment member 110 in the second modification example, similarly to the attachment member 50 in the first embodiment, when the battery 40 is removed from the battery accommodation portion 35, the attachment member 110 can be easily mounted to and removed from the back wall 33 of the casing 3. Further, the rotation of the attachment member 110 is regulated by the pair of the spherical chamfered portions 117 of the joint spherical body 114. With this structure, when the printer 1 is in the carried state of being suspended from a shoulder or a neck through use of the strap, the printer 1 can be kept in a stable state when the recording sheet P1 is cut through use of the first cutting blade 26 or the second cutting blade 27 (see FIG. 2). Further, according to the attachment member 110 in the second modification example, similarly to the attachment member 50 in the first embodiment, the first rib 82 and the second rib 83 may be formed at both end portions of the support bracket 81, respectively.

Next, description is made of a printer 130 according to a second embodiment of the present invention with reference to FIG. 11A and FIG. 11B and FIG. 12A to FIG. 12C. In the printer 130 according to the second embodiment, components that are the same as or similar to those of the printer 1 according to the first embodiment are denoted by the same reference symbols, and detailed description thereof is omitted.

Second Embodiment

FIG. 11A is a perspective view for illustrating the printer 130 as seen from the back wall 33 side. FIG. 11B is a perspective view for illustrating a belt clip 132. As illustrated in FIG. 11A and FIG. 11B, in the printer 130, the clip 132 is used under place of the attachment member 50 of the printer 1 according to the first embodiment, and the remaining configuration is the same as that of the printer 1 according to the first embodiment. In the following description, the clip 132 is referred to as, for example, the belt clip 132. The belt clip 132 is integrally formed of a resin material, and includes a clip main body 133 and a connecting projecting portion (joint portion) 134. The clip main body 133 includes a first clip portion 136 and a second clip portion 137. The first clip portion 136 is formed into a rectangular shape, and the second clip portion 137 is formed integrally with a proximal portion 136*a* of the first clip portion 136.

By elastically deforming the second clip portion 137 to separate a distal end portion 137*a* of the second clip portion 137 away from the first clip portion 136, a belt on a user for the printer 130 can be fitted into a space between the first clip portion 136 and the second clip portion 137. In this manner, the belt clip 132 can be mounted to the belt on the user. The connecting projecting portion 134 is formed integrally with the proximal portion 136*a* of the first clip portion 136.

The connecting projecting portion 134 is protruded from the proximal portion 136*a* of the first clip portion 136 to a side opposite to the second clip portion 137. The connecting projecting portion 134 includes a joint neck portion 141, a joint spherical body 142, and a joint shank portion 143. The joint neck portion 141, the joint spherical body 142, and the joint shank portion 143 are integrally formed of a resin material to be coaxial with each other in the Z direction.

As illustrated in FIG. 5 and FIG. 11B, the joint neck portion 141 is formed into a columnar shape, and is fitted to the first opening portion 62 of the connecting recessed portion 61 so as to be freely rotatable. The joint spherical body 142 is formed into a spherical shape, and is fitted to the spherical receiving portion 64 of the connecting recessed portion 61 so as to be freely rotatable. In this state, a contact state of the joint spherical body 142 with, for example, the spherical receiving portion 64 of the connecting recessed portion 61 is kept. The joint spherical body 142 has a spherical surface having a ball joint shape, and includes a pair of spherical chamfered portions 146. In the following description, the pair of spherical chamfered portions 145 and 146 is referred to as the first spherical chamfered portion 145 and the second spherical chamfered portion 146.

The first spherical chamfered portion 145 and the second spherical chamfered portion 146 are formed to be flat on both side portions of the joint spherical body 142, which are opposed to each other in the Y direction under a state in which the belt clip 132 is mounted at a mounting position in the back wall 33 of the casing 3.

Under a state in which the belt clip 132 is mounted at the mounting position in the back wall 33 of the casing 3, the first spherical chamfered portion 145 and the second spherical chamfered portion 146 are arranged at positions of being opposed to the first chamfered portion 71 and the second chamfered portion 72 of the connecting recessed portion 61, respectively. In this state, a contact state of the first spherical chamfered portion 145 with, for example, the first chamfered portion 71 and a contact state of the second spherical chamfered portion 146 with, for example, the second chamfered portion 72 are kept. In this case, for example, under a state in which the first spherical chamfered portion 145 is opposed to the first chamfered portion 71, the first rotation regulating portion is formed. Further, under a state in which the second spherical chamfered portion 146 is opposed to the second chamfered portion 72, the second rotation regulating portion is formed.

With this structure, under a state in which the belt clip 132 is arranged at the mounting position along the back wall 33 of the casing 3, the first rotation regulating portion and the second rotation regulating portion can regulate the belt clip 132 from shifting from the mounting position. Accordingly, with a simple configuration having the connecting projecting portion 134 of the belt clip 132 and the connecting recessed portion 61, the belt clip 132 can be fitted so as to be rotatable with respect to the connecting recessed portion 61, and can be regulated from shifting from the mounting position. Thus, the number of components of the printer 130 is reduced so that increase in cost can be avoided and space saving of the printer 130 can be achieved.

As illustrated in FIG. 11A, the belt clip 132 (or the connecting projecting portion 134) can be stably held at the mounting position. Accordingly, for example, when the printer 130 is mounted to the belt through intermediation of the belt clip 132, the belt clip 132 can be stabilized. With this structure, work for mounting the printer 130 to the belt on the user is facilitated, thereby being capable of enhancing operability of the printer 130. Moreover, under a state in which the first rotation regulating portion and the second rotation regulating portion regulate the belt clip 132 from shifting from the mounting position, the battery 40 is covered with the belt clip 132. With this structure, the belt clip 132 can prevent the battery 40 from falling off the battery accommodation portion 35 of the casing 3.

Figure 12A:
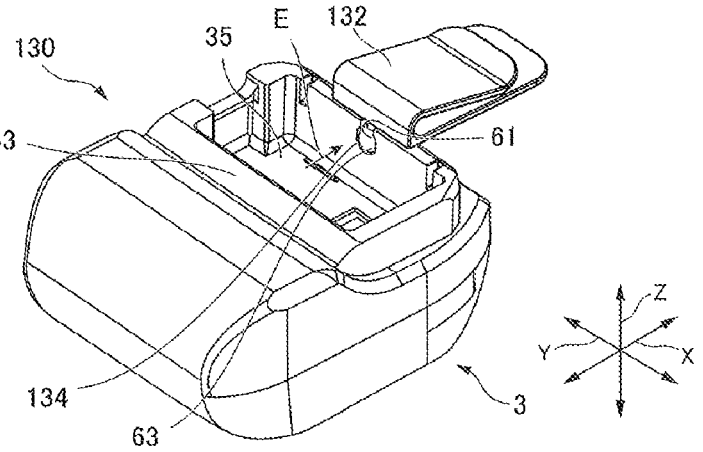
FIG. 12A is a perspective view for illustrating an example in which a ball joint portion of the belt clip is fitted to the connecting recessed portion of the casing in the second embodiment of the present invention.
Figure 12B:
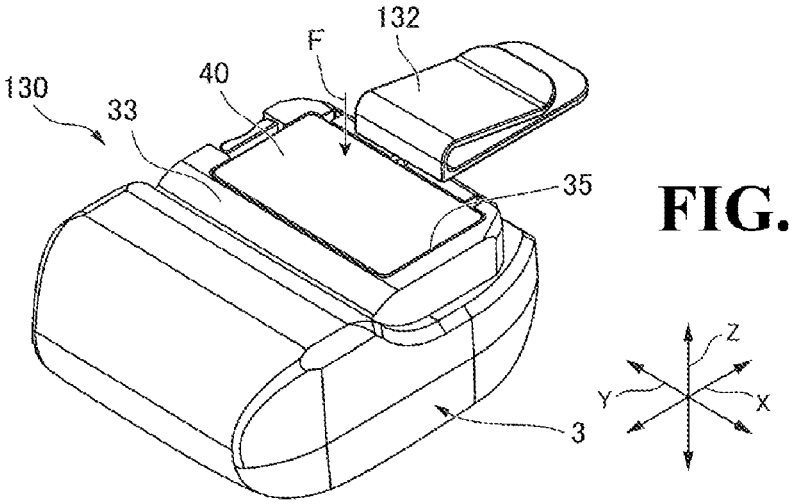
FIG. 12B is a perspective view for illustrating an example in which the battery is accommodated in the battery accommodation portion of the casing.
Figure 12C:
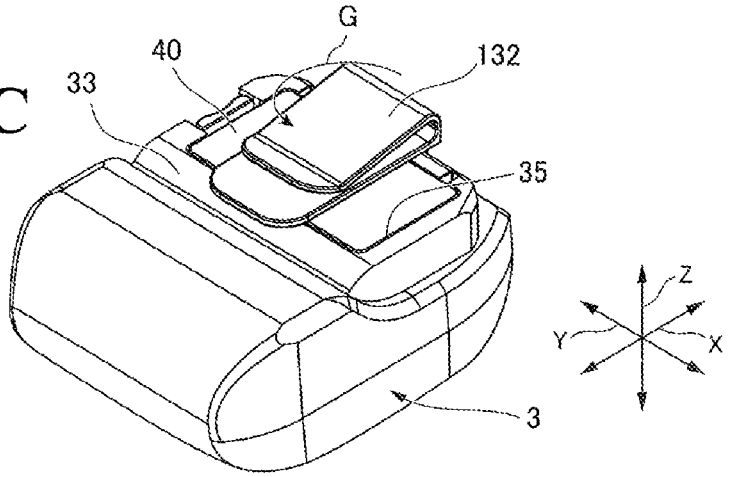
FIG. 12C is a perspective view for illustrating an example in which the battery is covered with the belt clip.

Next, with reference to FIG. 12A to FIG. 12C, description is made of an example in which the belt clip 132 is mounted to the back wall 33 of the casing 3. FIG. 12A is a perspective view for illustrating an example in which the connecting projecting portion 134 of the belt clip 132 is fitted to the connecting recessed portion 61 of the casing 3. FIG. 12B is a perspective view for illustrating an example in which the battery 40 is accommodated in the battery accommodation portion 35 of the casing 3. FIG. 12C is a perspective view for illustrating an example in which the battery 40 is covered with the belt clip 132. As illustrated in FIG. 12A, under a state in which the battery 40 (see FIG. 11A) is removed from the battery accommodation portion 35, the connecting projecting portion 134 of the belt clip 132 is fitted to the connecting recessed portion 61 through the second opening portion 63 of the connecting recessed portion 61 in a direction indicated by the arrow E.

As illustrated in FIG. 12B, under a state in which the connecting projecting portion 134 of the belt clip 132 is fitted to the connecting recessed portion 61 (see FIG. 12A), the belt clip 132 is arranged at a position of avoiding the battery accommodation portion 35 (position of being separated away from the battery accommodation portion 35 in the X direction). In this state, the battery 40 is accommodated in the battery accommodation portion 35 of the casing 3 in a direction indicated by the arrow F.

As illustrated in FIG. 12C, the belt clip 132 is turned about the connecting projecting portion 134 (FIG. 11B) in a direction indicated by the arrow G. The battery 40 is covered with the belt clip 132. Thus, the belt clip 132 can prevent the battery 40 from falling off the battery accommodation portion 35 of the casing 3.

Meanwhile, when the belt clip 132 is removed from the back wall 33 of the casing 3, the belt clip 132 is rotated in a direction opposite to the direction indicated by the arrow G. The belt clip 132 is arranged at a removable position (see FIG. 12B). As illustrated in FIG. 12B, the belt clip 132 is arranged at the removable position so that the belt clip 132 is arranged at the position of avoiding the battery 40. Accordingly, the battery 40 can be removed from the battery accommodation portion 35. As illustrated in FIG. 12A, when the battery 40 is removed from the battery accommodation portion 35, the connecting projecting portion 134 of the belt clip 132 can be easily removed from the connecting recessed portion 61 to the battery accommodation portion 35 side.

Note that, the technical scope of the present invention is not limited to the above-mentioned embodiments, but various modifications may be made without departing from the gist of the present invention. For example, in the first embodiment, description is made of the example in which two rotation regulating portions, namely, the first rotation regulating portion 95 and the second rotation regulating portion 96 are provided as the rotation regulating portion, but the present invention is not limited thereto. As another example, for example, three or more rotation regulating portions may be provided.

What is claimed is:

1. A printer, comprising:

a housing configured to accommodate a recording sheet and a printing portion;

an attachment member, which is removably mounted to the housing, and has a hook hole for a strap;

a battery accommodation portion formed in the housing; and a battery, which is to be removably mounted to the battery accommodation portion, wherein a portion of the housing, to which the attachment member is mounted, and the attachment member form a rotation regulating portion configured to regulate rotation of the attachment member, wherein the housing includes a connecting recessed portion having an opening portion formed in a side wall of the battery accommodation portion, wherein the attachment member includes a connecting projecting portion that is removably fitted to the connecting recessed portion through the opening portion, wherein, under a state in which the connecting projecting portion is fitted to the connecting recessed portion, when the battery is mounted to the battery accommodation portion, the attachment member is mounted to the housing, and wherein the rotation regulating portion is formed by the connecting projecting portion and the connecting recessed portion.

2. The printer according to claim 1, wherein the rotation regulating portion includes an engagement portion configured to regulate oration of the attachment member.

3. The printer according to claim 2, wherein the attachment member includes a rib configured to regulate the rotation of the attachment member by being fitted to the housing.

4. The printer according to claim 1, wherein the attachment member includes a rib configured to regulate the rotation of the attachment member by being fitted to the housing.

* * * * *